United States Patent [19]

Beise et al.

[11] 4,166,579

[45] Sep. 4, 1979

[54] PAINT SPRAYER SAFETY INTERLOCK

[75] Inventors: Theodore W. Beise, Villa Park; Robert D. Rice, Western Springs, both of Ill.

[73] Assignee: Stewart-Warner Corporation, Chicago, Ill.

[21] Appl. No.: 877,533

[22] Filed: Feb. 13, 1978

Related U.S. Application Data

[63] Continuation of Ser. No. 721,116, Sep. 7, 1976, abandoned.

[51] Int. Cl.[2] ..... B05B 7/02

[52] U.S. Cl. ..... 239/526

[58] Field of Search ..... 239/526, 527, 528, 583; 251/98, 99, 108, 109, 111, 114

[56] References Cited

U.S. PATENT DOCUMENTS

| | | | |
|---|---|---|---|
| 994,955 | 6/1911 | Sayre | 251/109 X |
| 1,643,969 | 10/1927 | Tittemore et al. | 239/526 |
| 2,934,308 | 4/1960 | Kaufmann | 251/114 |
| 2,991,945 | 7/1961 | Rosenkranz | 251/114 X |
| 3,380,705 | 4/1968 | Enssle | 239/526 X |
| 3,396,937 | 8/1968 | McDougall | 251/107 |
| 3,515,355 | 6/1970 | Wagner | 239/526 |
| 3,780,953 | 12/1973 | Malec | 239/526 |

*Primary Examiner*—John J. Love

[57] ABSTRACT

A high pressure, airless paint spray gun having a body with a nozzle at the forward end, a reciprocating valve operator for the nozzle and a pivotal hand lever for operating the valve operator and permitting paint to flow through the nozzle. Dual safety devices are provided for preventing the accidental depression of the hand lever and the accidental discharge of high pressure paint from the nozzle. One safety assembly consists of a pivotally mounted thumb lever on the back of the gun body that selectively receives or blocks a stem projecting rearwardly from the valve operator. The other safety assembly includes a trigger pivotally mounted on the hand lever that grabs a projection extending downwardly from the body and selectively prevents accidental pivotal movement of the hand lever.

10 Claims, 7 Drawing Figures

10
10
21
64
56
59
16
58
57
66
60
61
12
40
13
25
19
47
49
50
51
52
65
33
35
31
43
45
44
48
26
53
55
70
73
11
34
36
37
32
42
23
46
14
77
75
74
76
17
69
71
27
15
20
72
28
29

LOCKED
OPEN

PAINT SPRAYER SAFETY INTERLOCK

This application is a continuation of my application Ser. No. 721,116, filed Sept. 7, 1976 now abandoned.

BACKGROUND OF THE PRESENT INVENTION

Airless paint spray equipment has found considerable commercial acceptance over recent years. Because of the design of such equipment, paint being discharged from the spray gun may range in pressure from 2000 psi to 5000 psi, depending upon the type of nozzle used and the viscosity of the material being pumped. Paint under pressure in this range can be extremely dangerous to personnel in the immediate area of spraying because since it may easily penetrate and damage living tissue.

This has given rise to the need for safety devices to prevent the accidental discharge of high pressure paint from airless paint spray guns. While safety devices have been provided for many types of hand lever operated tools and other equipment, they are not suitable for the present airless paint spray gun, nor do they provide the degree of safety required for this high pressure application.

SUMMARY OF THE PRESENT INVENTION

According to the present invention, a high pressure, air-less paint spray gun is provided that has two safety devices or assemblies to prevent the inadvertent discharge of paint under high pressure from the tip or nozzle. The gun includes a body having a forwardly projecting receiver portion and a downwardly projecting handle. A paint inlet fitting is received in the end of the body receiver portion and supports a nozzle or tip assembly. A ball valve operating assembly is reciprocally mounted within the body and inlet fitting, and is spring biased to a closed position by a spring assembly. The operator assembly has a cylindrical member which is engaged and reciprocated by a hand lever pivotally mounted on the receiver.

Two safety devices or assemblies are provided to prevent the inadvertent discharge of paint through the gun nozzle or tip. The first of these assemblies includes a pivotally mounted thumb lever or swivel on the back of the body receiver having an aperture therein facing the receiver. A stem extends rearwardly from the cylindrical operator and is blocked, along with the valve operator assembly, from rearward movement by the thumb lever when the thumb lever is in a position with the aperture out of alignment with the rearwardly projecting stem. When the operator pivots the thumb lever to a position with the aperture in alignment with the stem, the stem may move freely rearwardly and the valve operator is permitted to open the nozzle valve.

The other safety device or assembly includes a pivotally mounted trigger on the hand lever which is spring biased to a position where it grasps a member projecting downwardly from the body preventing pivotal movement of the hand lever. When the safety trigger is pivoted by the operator's index finger, away from engagement with the downward projection, and the first safety device is in its open position, the hand lever may be pivoted and the valve operator opened.

DETAILED DESCRIPTION OF THE PREFERRED EMBODIMENT

Figures 1, 2:
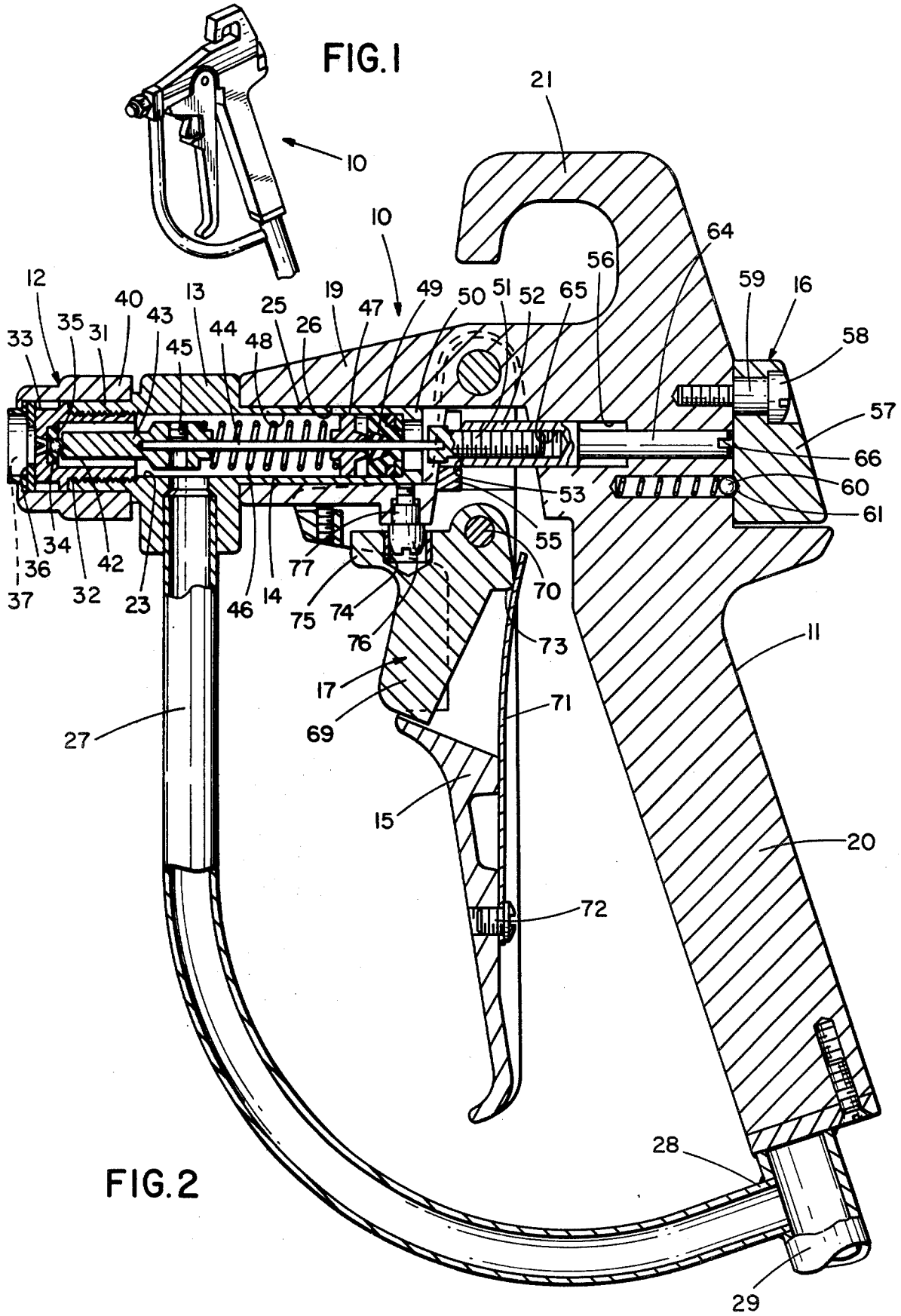
FIG. 1 is a perspective view of the present airless paint gun.
FIG. 2 is an enlarged longitudinal section of the present paint spray gun with both safety devices in their "on" positions.

Referring to the drawings, and particularly FIGS. 1 and 2, a paint spray gun 10 is illustrated generally including a body 11, a nozzle or tip assembly 12, an inlet fitting 13, a valve operator assembly 14, and a pivotally mounted hand lever 15 for reciprocating the operator assembly 14.

Safety assemblies 16 and 17 are provided for preventing the inadvertent reciprocation of the valve operator assembly 14.

This body 11 includes a forwardly projecting receiver portion 19 and a downwardly projecting handle or grip portion 20 and an upwardly and forwardly projecting hanger portion 21.

The annular inlet fitting 13 has a central bore 23 and a rearwardly extending sleeve 25 received in bore 26 in the receiver portion 19. Inlet fitting 13 receives conduit 27 which is connected at its other end 28 to conduit 29 that receives paint from the associated paint pump apparatus (not shown). The inlet fitting 13 has a forwardly projecting sleeve portion 31 that receives a nozzle bushing 32 having nozzle apertures 33 therein. A valve seat 34 is received in a counterbore 35 in bushing 32. The nozzle bushing 32, washer 36 and hood flange 37 are all held in position in inlet fitting 13 by an end cap 40 threadedly received on forwardly projecting sleeve 31. Ball valve 42 controls the flow of fluid through valve seat 34 and nozzle passages 33.

The operator assembly 14 is provided for opening and closing the ball valve 42 in response to depression of the hand lever 15.

Toward this end, an elongated valve holding member 43 is provided axially slidable within bushing 34 and centrall passage 23 in the inlet fitting 13. The valve holding member 43 receives at its rear end a narrow rod 44 which is held in the valve holding member 43 by a set screw 45. The valve holding member 43 is urged toward the valve closed position by a coil spring 46 which reacts against a spring seat 47 in bore 48 in the body receiver 19. Spring seat 47 in turn reacts against a centrally apertured plug 49 also in receiver bore 48, which in turn engages an annular projection 50 on the inner end of the sleeve 25.

Figures 3, 4, 5, 6:
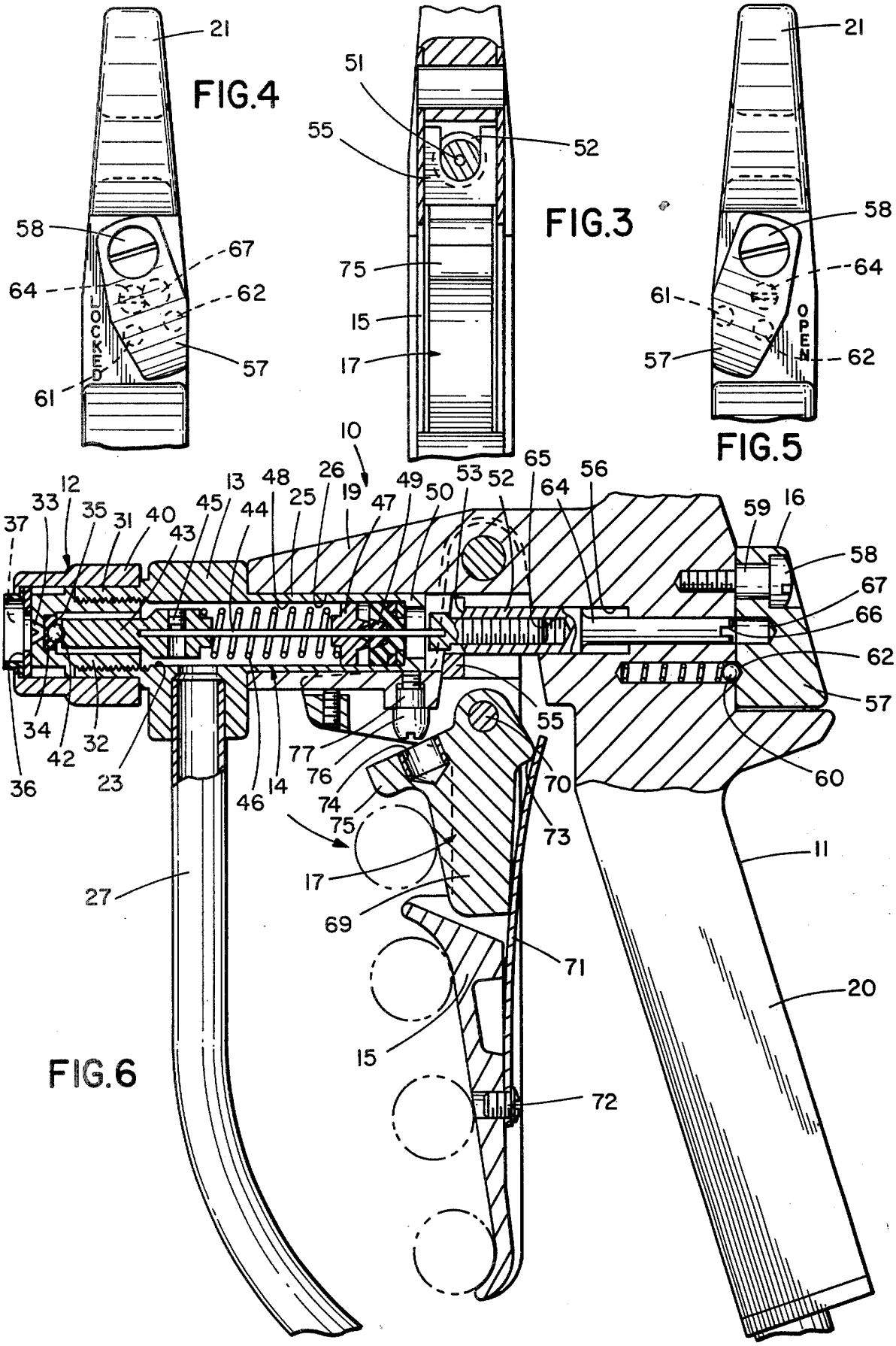
FIG. 3 is a cross-section taken generally along line 3—3 of FIG. 2 illustrating the operating lever.
FIG. 4 is a fragmentary rear view of the present gun with the thumb lever in the "on" position.
FIG. 5 is a fragmentary rear view of the present gun with the thumb lever in the "off" position.
FIG. 6 is a longitudinal section with both safety devices "off"

The inner end of rod 44 is fixed to a threaded member 51, threadedly received in cylindrical operating member 52 having an annular end portion 53 which is engaged by a U-shaped member 55 as shown in FIG. 3, for the purpose of actuating the operating assembly 14 and opening the valve 42. The rear end of the operating member 52 is slidably received in a bore 56 in the rear end of the receiver.

The first safety assembly 16 includes a thumb lever 57 pivotally mounted on and held against the rear end of the receiver 19 by a fastener 58 having a swivel boss 59 thereon. A spring biased ball detent 60 in the receiver 19 is provided for holding the lever or swivel 57 in one of two positions. The ball detent 60 is adapted to engage detents 61 and 62 selectively to hold the safety lever 57 in either the "on" position shown in FIGS. 2 and 4, or the "off" position shown in FIGS. 5, 6 and 7. When in the "on" position shown in FIGS. 2 and 4, the lever 57 blocks the rearward movement of a stem 64 extending rearwardly from operating member 52 in the receiver. The rear end of stem 64 has a slot 66 for receiving a suitable tool for threading the operator member 52 on member 51.

Figure 7:
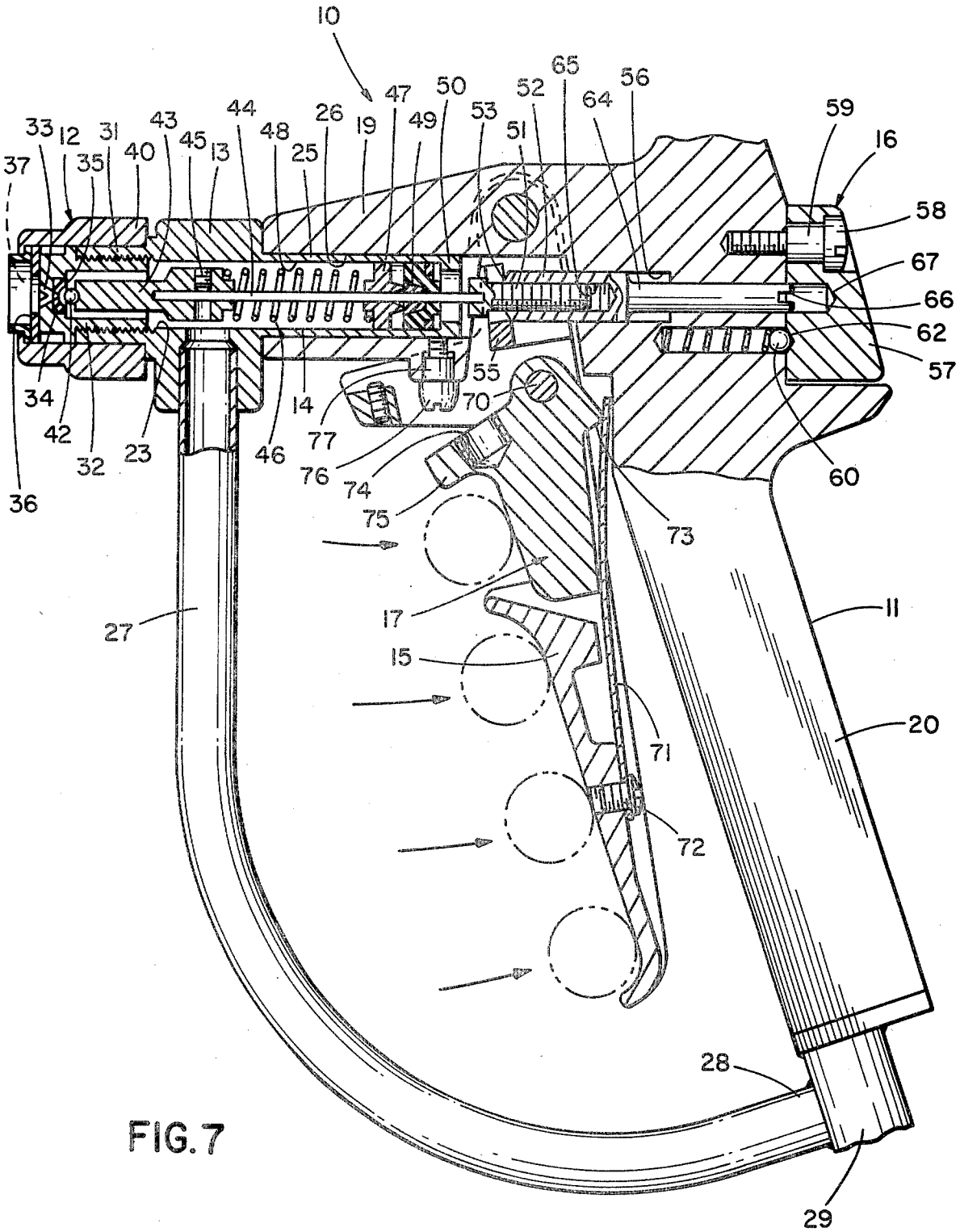
FIG. 7 is a longitudinal section of the present gun with both safety devices "off" and the hand lever operated.

When in the safety "off" position, as shown in FIGS. 5, 6 and 7, an aperture 67 is aligned with stem 64. Ball detent 60 engages detent 62 in this position. Thus, upon rearward movement of the operator assembly, the stem 64 enters aperture 67 and the operator assembly is permitted to move rearwardly and open the valve 42.

The second safety assembly 17 includes a lever or trigger 69 pivotal on a pin 70 carried by the bifurcated hand lever 15. A leaf spring 71 fixed to handle 15 by threaded fastener 72 engages a rearward cam portion 73 on the trigger 69 urging the trigger in a clockwise direction as viewed in FIGS. 2, 6 and 7. The trigger 69 is in the safety "on" position in FIG. 2 and in that position an aperture 74 in a forward projection 75 engages a crowned head 76 on a threaded fastener 77, threadedly received in an aperture in the lower portion of the receiver 19. Spring 71 biases the trigger 69 into engagement with the crowned head 76 holding the trigger in the safety "on" position preventing pivotal movement of the hand lever 15 and hence actuation of the operator mechanism 14.

Both safety assemblies 16 and 17 are shown in their "off" position in FIG. 2 and in this position, the two assemblies 16 and 17 independently prevent operation of the valve operator mechanism 14. Safety assembly 16 does so by blocking rearward movement of stem 64 and trigger assembly 17 does so by preventing movement of the hand lever 15. When the operator desires to discharge paint from the gun, the lever 57 is shifted with the operator's thumb to the safety "off" position shown in FIGS. 5 and 6. Thereafter, the operator grasps handle 15 and depresses the trigger 69 as shown in FIG. 6, releasing the trigger from the crown 76 of threaded fastener 77. This permits the pivotal movement of handle 15 as shown in FIG. 7 so that the portion 55 of the handle engages annular portion 53 on operator 52 moving the operator assembly 14 rearwardly with the stem 64 entering the aperture 67 as shown in FIG. 7 permitting discharge of paint through the nozzle 12. When the trigger 69 and hand lever 15 are released by the operator, spring assembly 48 will urge the operator assembly 14 towards the closed position and annular portion 53 will pivot the handle 15 forwardly. At the same time, spring 71 will pivot the trigger 69 into engagement with the crown 76 automatically placing the trigger assembly 17 in the safety "on" position shown in FIG. 2.

What is claimed is:

1. A paint spray gun, comprising, a body having a handle, nozzle means in said body, a valve for controlling the flowing paint to said nozzle means, a reciprocating operator for said valve, a lever mounted on said body for reciprocating said operator, a safety device for preventing movement of said operator including a safety element on said body movable between first and second positions and pivotally mounted on said body above the handle on an axis spaced from the axis of the operator so that it may be thumb operated, and said safety element having an aperture therein facing said body for receiving a portion of said operator when the element is in said second position.

2. A paint spray gun, comprising, a body having a handle, nozzle means in said body, a valve for controlling the flowing paint to said nozzle means, a reciprocating operator for said valve, a lever mounted on said body for reciprocating said operator, a safety device for preventing movement of said operator including a safety element on said body movable between first and second positions, said element in the first position blocking movement of said reciprocating operator, said element in the second position permitting movement of said operator, wherein said safety element is pivotally mounted on said body above the handle so that it may be thumb operated, said safety element has an aperture therein facing said body for receiving a portion of said operator when the element is in said second position, including a second safety device, said second safety device including a lever for selectively preventing movement of said operator lever, said second safety device including a finger lever pivotally mounted on said operating lever, projection means extending from beneath said body, said second device lever being movable from a first to a second position, said second driver in said first position engaging said projecting means and preventing movement of said operating lever, said second device lever when in the second position permitting movement of said operating lever.

3. A paint spray gun, comprising; a body having a handle nozzle means in said body, a valve for controlling the flow of paint to said nozzle means, a reciprocating operator for said valve, a lever mounted on said body for reciprocating said operator, a safety device for preventing movement of said operator including a safety element on said body movable between first and second positions, said element in the first position blocking movement of said reciprocating operator, said element in the second position permitting movement of said operator, said safety element being pivotally mounted on said body above the handle so that it may be thumb operated, said safety element having an aperture therein facing said body for receiving a portion of said operator when the element is in said second position and a second safety device, said second safety device including a lever extending beneath the body for selectively preventing movement of said operator lever.

4. A paint spray gun, comprising; a body having a handle, nozzle means in said body, a valve for controlling the flow of paint to said nozzle means, a reciprocating operator for said valve, an operator lever mounted on said body for reciprocating said operator, a safety device for preventing movement of said operator including a safety element on said body movable between first and second positions, said element in the first position blocking movement of said reciprocating operator, said element in the second position permitting movement of said operator, said safety element being pivotally mounted on said body above the handle so that it may be thumb operated, said safety element having an aperture therein facing said body for receiving a portion of said operator when the element is in said second position, a second safety device for selectively preventing movement of said operator lever, said second safety device including a lever pivotally mounted on said operator lever beneath the body, projection means on said body, said second device lever being movable from a first to a second position, said device lever in said first position engaging said projection and preventing movement of said operator lever, said second device lever when in the second position permitting movement of said operator lever.

5. A paint spray gun, comprising; a body having a handle, nozzle means in said body, a valve for controlling the flowing paint to said nozzle means, a reciprocating operator for said valve, an operator lever mounted on said body for reciprocating said operator, a safety device for preventing movement of said operator including a safety element on said body movable between first and second positions, said element in the first position blocking movement of said reciprocating operator, said element in the second position permitting movement of said operator, said safety element being pivotally mounted on said body above the handle so that it may be thumb operated, said safety element having an aperture therein facing said body for receiving a portion of said operator when the element is in said second position, a second safety device for selectively preventing movement of said operator lever, said second safety device including a lever pivotally mounted on said operating lever beneath the body, projection means on said body, said second device lever being movable from a first to a second position, said second driver in said first position engaging said projection and preventing movement of said operating lever, said second device lever when in the second position permitting movement of said operating lever, and said second device lever including a pivotally mounted trigger positioned for movement by the operator's index finger.

6. A paint spray gun, comprising; an elongated body having a handle projecting downwardly from one end thereof, a nozzle at the other end of said body, a ball valve for controlling the flow of paint to said nozzle, a reciprocable operator in said body for moving said valve, said operator having an end portion selectively projectable from said one end of said body when the valve is open, a thumb operable pivotally mounted safety element at said one end of said body, detent means providing first and second positions for said safety element, an aperture in said safety element facing said body and being in alignment with said operator when said element is in the second position and being out of alignment with said operator when said element is in the first position, an operating lever pivotally mounted on said body and connected to shift said operator between said first and second positions, said operator lever extending generally parallel to said handle so that it may be grip operated, a projection extending downwardly from said body adjacent said operator lever, a trigger pivotally mounted on said operating lever adjacent the upper portion thereof, said trigger having an opening for engaging said projection when the operator lever is in its inoperative position for preventing accidental movement of the operating lever, said trigger when pivoted from engagement with said projection permitting movement of the operator lever.

7. A paint spray gun as defined in claim 6, including a spring on said lever biasing said trigger, a second spring biasing said operator and valve toward a closed position.

8. A paint spray gun, comprising; a body, a handle projecting downwardly from said body, a reciprocable operator in said body, a pivotal lever operator for reciprocating said operator, a safety device for selectively preventing movement of said operator lever including a pivotally mounted trigger on said operator lever, a projection extending downwardly from said body, said trigger having a recess for grasping said projection and preventing movement of said operator lever.

9. A paint spray gun, comprising; a body having a handle, nozzle means in said body, a valve for controlling the flow of paint to said nozzle means, an operator for said valve including a lever mounted on said body, a safety device for preventing movement of said operator including a safety element on said body movable between first and second positions and pivotally mounted on said body above the handle on an axis spaced from the axis of the operator so that it may be thumb operated, a projection movable by said operator, and said safety element having an aperture therein facing said body for receiving a portion of said projection when the element is in the second position.

10. A spray gun, comprising; a body a handle projecting from said body, a reciprocable operator in said body, a pivotal lever for reciprocating the operator, a safety device for selectively preventing movement of said lever including a pivotally mounted trigger on the lever, a projection extending from beneath the body, said trigger having a surface for grasping the projection and preventing movement of the lever and operation of the spray gun.

* * * * *